US005918842A

United States Patent [19]

Garfinkle

[11] Patent Number: 5,918,842

[45] **Date of Patent: *Jul. 6, 1999**

[54] FIXTURE TAG MOLDING ADAPTER

[76] Inventor: Benjamin L. Garfinkle, 1120 Portal Ave., Piedmont, Calif. 94610

[ * ] Notice: This patent is subject to a terminal disclaimer.

[21] Appl. No.: 08/911,798

[22] Filed: Aug. 15, 1997

Related U.S. Application Data

[63] Continuation-in-part of application No. 08/708,592, Sep. 5, 1996, Pat. No. 5,697,589.

[51] Int. Cl.[6] ..... A47B 96/06

[52] U.S. Cl. ..... 248/223.41; 248/221.4; 403/106; 211/94.01

[58] Field of Search ..... 248/223.4, 468, 248/475.1, 228.7, 229.16, 316.7, 225.11, 231.21, 231.81, 221.12; 403/106, 107, 105, 104; 211/94.01

[56] References Cited

U.S. PATENT DOCUMENTS

| | | | |
|---|---|---|---|
| 3,015,177 | 1/1962 | Hembd et al. | 248/233.41 |
| 3,276,800 | 10/1966 | Loudon et al. | 287/189.35 |
| 3,711,973 | 1/1973 | Slavsky | 40/11 R |
| 4,805,331 | 2/1989 | Boggess et al. | 40/651 |
| 4,881,707 | 11/1989 | Garfinkle | 248/221.4 |
| 5,111,606 | 5/1992 | Reynolds | 40/642 |
| 5,148,925 | 9/1992 | Althoff et al. | 211/41 |
| 5,381,908 | 1/1995 | Hepp | 211/184 |
| 5,397,091 | 3/1995 | Tsuar | 248/441.1 |
| 5,697,589 | 12/1997 | Garfinkle | 248/223.41 |

*Primary Examiner*—Leslie A. Braun
*Assistant Examiner*—Kimberly Wood
*Attorney, Agent, or Firm*—Malcolm B. Wittenberg

[57] ABSTRACT

A fixture holder attachment means for attaching a sign assembly to a C-shaped channel molding extending from an edge of a horizontal shelf. By providing internal baffling, once the U-shaped fixture holder attachment means is captured by the C-shaped channel molding, outwardly extending pressure can be applied to the legs of the U-shaped fixture holder attachment means preventing its inadvertent removal from the C-shaped channel.

2 Claims, 3 Drawing Sheets

FIXTURE TAG MOLDING ADAPTER

The present application is a continuation-in-part of U.S. application Ser. No. 08/708,592 filed on Sep. 5, 1996 now U.S. Pat. No. 5,697,589.

TECHNICAL FIELD OF THE INVENTION

The present invention relates generally to a device employed as a means for attaching a fixture holder to C-shaped channel molding which generally is applied to edges of horizontal shelving in most supermarket or grocery store facilities.

BACKGROUND OF THE INVENTION

In supermarkets, grocery stores and other environments where virtually every product must be identified by some type of signage, there is recognized to be a continuous need for a fixture which brings a shopper's attention to a specific item and informs the shopper of the identification of the item and its unit pricing. This is particularly important in current supermarket facilities where most products are not individually identified with a product price but are instead identified by a bar code which is only machine-readable. As such, without appropriate fixture in the shape of, for example, signage, the shopper would be unable, in most instances, to discern a product price merely by examining the product itself.

Most supermarket or grocery store facilities are provided with horizontal shelving and, at the outer edge of each shelf, is provided a C-shaped channel such as is identified as element 1 having inwardly facing lips 2 and 3 (FIG. 1).

As being illustrative of the prior art, attention is directed to FIG. 1 which depicts an invention made the subject of applicant's previously issued U.S. Pat. No. 4,881,707 which issued on Nov. 21, 1989. In this illustration, a fixture in the form of sign holder assembly 10 is provided with frame member 11 capable of supporting and displaying a sign in a substantially vertical orientation made visible to the consumer through opening 12. Frame member 11 is shown hingedly connected through hinge 13 and, in turn, to attachment means 22 configured as a U-shaped member having outwardly facing protruding flat sections 23.

In use, U-shaped member 22 is applied to C-shaped channel 25 by applying inward pressure to legs 14 and 15 generally by one's thumb and index finger so that outwardly facing protruding flat sections 23 can slip between and become captured by inwardly facing lips 2 and 3.

Although the arrangement depicted in FIG. 1 is generally adequate to display appropriate signage at the edge of, for example, horizontally extending shelf 40, it has been found that when a consumer inadvertently engages a protruding sign holder or other product display identifier, U-shaped member 22 can easily disengage from C-shaped channel 1 resulting in the signage falling to the floor and remaining there until a store clerk reapplies the signage to its appropriate location.

The situation described above has been addressed in the past. Specifically, U-shaped member 22 has been provided with a set screw 50 passing within one of the legs of the U-shaped member which, when engaging the second leg of this member, acts to spread the legs apart and maintain contact between the outwardly facing protruding flat sections 23 and lips 2 and 3. This solution, although superficially seeming adequate, is not generally employed by grocery store personnel for they find that it is time consuming and physically awkward and employees do not always have the appropriate tool to apply and remove screws to U-shaped member 22 each time the U-shaped member is applied to and removed from a suitable store shelf. In addition, the cost of the screws and the labor to apply them are also significant particularly in comparison to the cost of the fixture holders themselves.

It is thus an object of the present invention to provide a means for the application and removal of suitable fixture attachment means to commonly used C-shaped channel molding which will maintain the fixture at the appropriate molding location until simple positive steps are conducted to removal the fixture when appropriate.

This and further objects will be more readily perceived when considering the following disclosure, appended drawings and claims.

SUMMARY OF THE INVENTION

The present invention involves a fixture holder attachment means and method for applying the attachment means to a suitable C-shaped channel molding located at an edge of a horizontal shelf. The fixture holder attachment means comprises a U-shaped member possessing outwardly facing protruding flat sections for engagement with a segment of a C-shaped channel molding. In a first embodiment, a ramp segment is located on a first leg of the U-shaped member and a baffle plate is hingedly located on a second leg of the U-shaped member. When the baffle plate and ramp segment are not in contact with one another, the U-shaped member can be compressed to facilitate its application to and removal from the C-shaped channel but when the baffle plate and ramp segment are in contact with one another, the U-shaped member cannot be sufficiently compressed to a degree where the outwardly protruding flat sections can be disengaged from the C-shaped channel.

In a second embodiment, a first leg of the U-shaped member is provided with means for releasably capturing an edge of the baffle while a second edge of the baffle, as in the first embodiment, is hingedly located on a second leg of the U-shaped member.

In a third embodiment, the baffle plate is loosely positioned between the legs of protruding flat sections of a suitable U-shaped member. In operation, the U-shaped member can be compressed to facilitate the application to and removal from the C-shaped channel. However, when the baffle plate is positioned to snugly engage the legs of the U-shaped member, the legs are caused to spread apart to a degree where its outwardly protruding flat sections cannot be disengaged from the lips of the C-shaped channel.

Finally, in a fourth embodiment, a first leg of a U-shaped member is provided with a cylindrical channel for rotatably receiving a baffle which itself has a complimentary cylindrical edge. When inserted, this baffle can rotate in contact with a second leg of the U-shaped member to prevent inadvertent release of the U-shaped member from its channel.

DETAILED DESCRIPTION OF THE INVENTION

Figure 1:
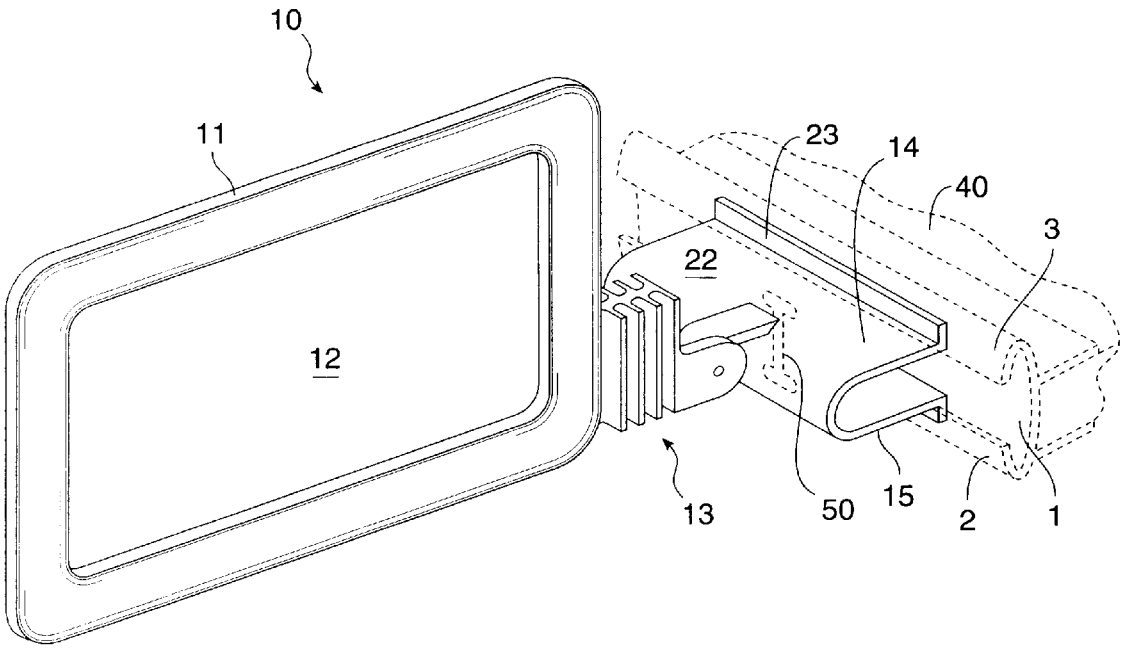
PRIOR ART FIG. 1
FIG. 1 is a perspective view of a fixture holder representing the state of the prior art.
Figure 2:
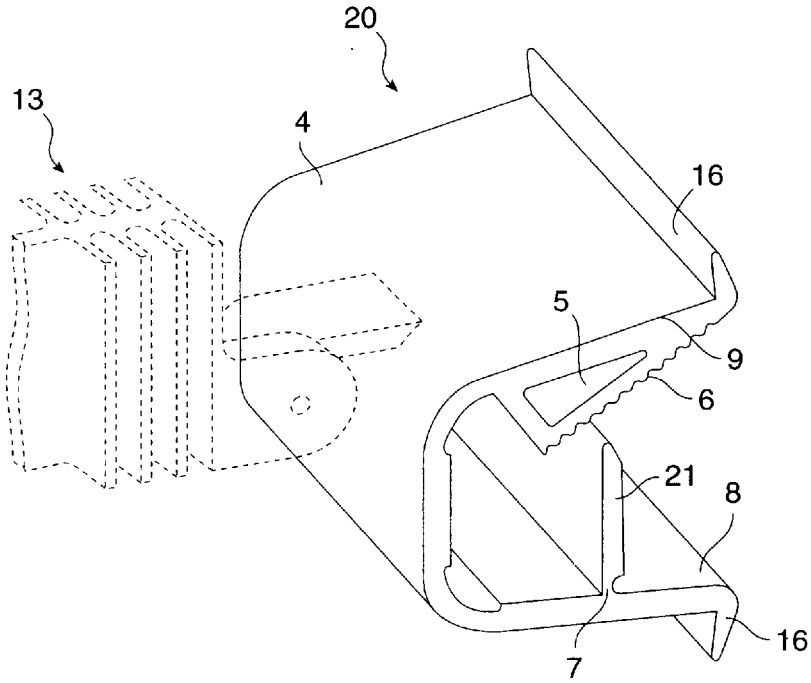
FIG. 2 is a perspective view of a first embodiment of the present invention.

As noted above, FIG. 2 represents one embodiment of the present invention. Specifically, fixture holder attachment means 20 is designed for attachment to a C-shaped channel molding extending from an edge of a horizontal shelf, neither of which are shown in FIG. 2 but are shown in phantom in FIG. 1. The fixture holder attachment means comprises U-shaped member 4 possessing outwardly facing protruding flat sections 16 for engagement with a segment of C-shaped channel molding.

U-shaped member 4 is provided with a ramp segment 5 which, as noted, preferably possesses a substantially triangular shape in profile. The ramp segment is located on first leg 9 of the U-shaped member. A second leg of the U-shaped member is provided with baffle plate 21 which is pivotally appended to leg 8 through hinge 7.

In operation, when baffle plate 21 is pivoted along hinge 7 so as not to contact ramp segment 5, the U-shaped member can be compressed generally by applying pressure by the thumb and forefinger to the outer surfaces of legs 8 and 9 so as to facilitate its application to and removal from a C-shaped channel molding. When legs of the U-shaped member are compressed, outwardly facing protruding sections 16 pass within and are captured by lips of the C-shaped channel molding as shown in FIG. 1. However, when the baffle plate is further rotated along hinge 7 and contacts ramp 5, legs 8 and 9 of U-shaped member 4 are caused to spread apart preventing inadvertent removal of the fixture holder attachment means from the C-shaped channel molding.

It is further noted in reference to FIG. 2 that ramp segment 5 is provided with a surface which is capable of releasably capturing the baffle plate such as being serrated. As such, when the baffle plate is caused to contact ramp segment 5, serrations 6 cause the baffle plate to remain in position until finger pressure is placed laterally against the inner surface of the baffle plate pushing an edge of the plate from the serrated surface which, in turn, eliminates outward pressure which the baffle has imposed upon the inner surfaces of legs 8 and 9.

Figure 3:
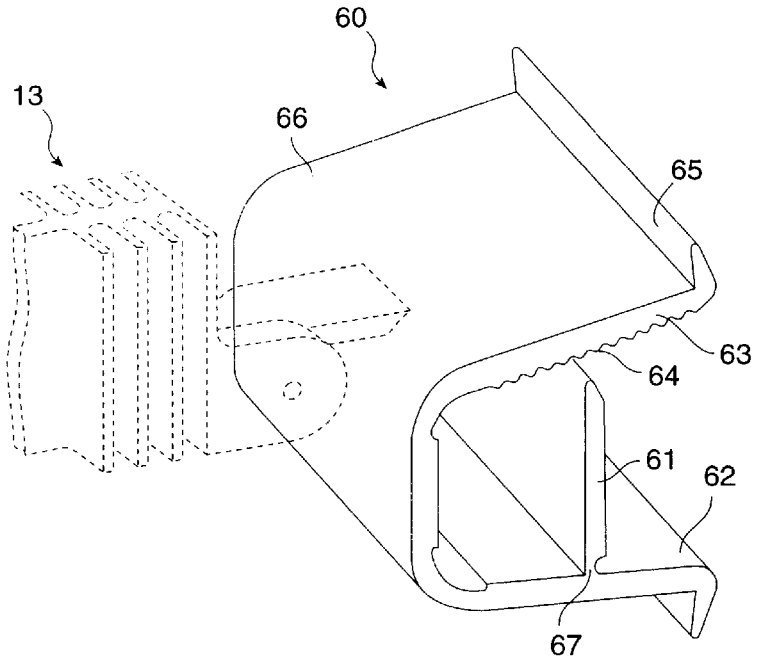
FIG. 3 is a perspective view of a second embodiment of the present invention.

Turning to FIG. 3, a second embodiment of the present invention is provided. Specifically, sign holder attachment means 60 is designed for attachment to a C-shaped channel molding extending from an edge of a horizontal shelf. The sign holder attachment means comprises U-shaped member 66 possessing outwardly facing protruding flat sections 65 for engagement with a segment of C-shaped channel molding.

Unlike the embodiment shown in FIG. 2, U-shaped member 66 is provided, not with a ramp segment, but simply a surface which is capable of releasably capturing baffle plate 61. Preferably, means for capturing baffle 61 comprises a series of serration 64 which facilitates the releasable capture of an edge of baffle plate 61 onto first leg 63 of U-shaped member 66. A second leg 62 of the U-shaped member is provided with baffle plate 61 which is pivotally appended to leg 62 through hinge 67.

Figure 4A:
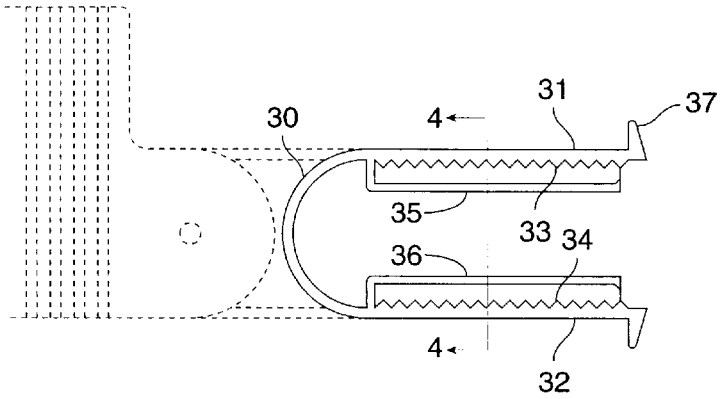
FIGS. 4*a* and 4*b* show the attachment means and baffle plate, respectively, of a third embodiment of the present invention.
Figure 4B:
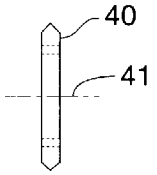
Figure 5:
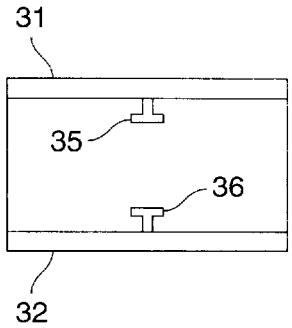
FIG. 5 shows the attachment means in cross-sectional view taken along line 4—4 of FIG. 4*a*.
Figure 6:
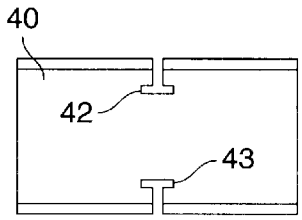
FIG. 6 illustrates a plan view of the baffle plate shown in FIG. 4*b*.

FIGS. 4 to 6 depict yet a third embodiment of the present invention. Specifically, in reference to FIG. 4*a*, the fixture holder attachment means comprises U-shaped member 30 possessing outwardly facing protruding flat sections 37 for engagement with a segment of C-shaped channel molding (not shown). As a preferred embodiment, the U-shaped member 30 is also shown as being characterized as having axis of symmetry 41 extending between legs 31 and 32 and outwardly facing protruding flat sections 37.

FIG. 4*b* depicts baffle plate 40 in side view. Baffle plate 40 is sized to fit between legs 31 and 32 of U-shaped member 30 and is inserted between legs 31 and 32 so as to be loosely held resulting in no outward pressure being applied to legs 31 and 32.

As noted by viewing FIGS. 5 and 6, it is contemplated that U-shaped member 30 be further provided with a pair of rails 35 and 36 which extend along and are spaced from legs 31 and 32. As shown in FIG. 5, rails 35 and 36 can be T-shaped in cross-section. Similarly, baffle 40 can be provided with a complimentary pair of channels 42 and 43 which are shown in FIG. 6 as also being T-shaped. As such, when baffle 40 is inserted between legs 31 and 32, rails 35 and 36 are captured within channels 42 and 43 to maintain baffle plate 40 between legs 31 and 32.

In operation, once baffle 40 has been inserted within legs 31 and 32, inward pressure is applied to legs 31 and 32 of U-shaped member 30 so that outwardly facing protruding flat sections 37 can be caused to pass within lips 2 and 3 of channel 1 (FIG. 1). However, as baffle 40 is brought from a loose position to a position where it snugly engages the legs of the U-shaped member, outward pressure is placed upon legs 31 and 32 thus substantially preventing inadvertent removal of the fixture holder attachment means. In this regard, as a preferred embodiment, the inner surfaces of legs 31 and 32 are provided with serrated surfaces 33 and 34 to capture edges of baffle plate 40 and prevent its unintentional misorientation. However, when one wishes to remove the fixture holder attachment means of the present invention, one need only apply lateral finger pressure to an edge of baffle plate 40 disengaging it from serrated surfaces 33 and 34 and allowing inwardly directed pressure upon legs 31 and 32 to squeeze these legs closer together and facilitate removal of outwardly facing protruding flat sections 33 from the inwardly turn lips of a suitable C-shaped channel molding.

Figure 7:
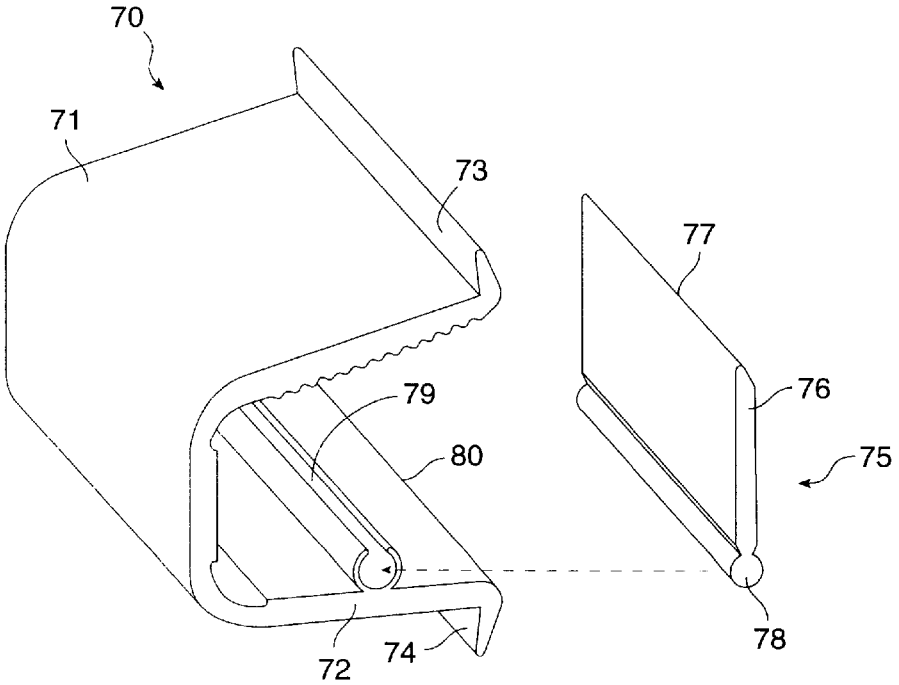
FIG. 7 is a perspective view of a fourth embodiment of the present invention.

FIG. 7 illustrates yet another embodiment of the present invention. Specifically, signholder attachment means 70 designed for attachment to a C-shaped channel molding extending from an edge of a horizontal shelf is depicted. The sign holder attachment means comprises a U-shaped member having outwardly facing legs 71 and 72 and protruding flat sections 73 and 74 intended to engage a segment of C-shaped channel molding. One leg 72 of U-shaped member 70 is provided with cylindrical channel 79 which generally extends along the length of leg 72 and which is parallel to corner 80 established at the intersection of leg 72 and outwardly extending member 74.

Baffle 75 of FIG. 7 differs from the baffle of elements previously disclosed in that it is provided with cylindrical edge 78 which is configured to run the length of baffle 76 as shown. Cylindrical edge 78 is sized to snap fit or to slide fit within cylindrical channel 79 enabling baffle 75 to rotate within U-shaped member 70. In operation, baffle 75 would rotate within cylindrical channel 72 so that edge 77 is not in contact with outwardly extending leg 71. At this point, thumb and finger pressure being applied to U-shaped member 70 will enable outwardly extending edges 73 and 74 to pass within and be captured by a suitable C-shaped channel whereupon baffle plate 75 can be rotated so that the baffle plate applies outwardly directed pressure to legs 71 and 72 substantially preventing inadvertent removal of the U-shaped member from its corresponding C-shaped channel element.

Although specific embodiments of the present invention have been illustrated and described, it will be understood that various alterations and details of construction can be made without departing from the scope of the invention as indicated by the appended claims.

I claim:

1. A fixture holder attachment means for attachment of a sign assembly to a C-shaped channel molding extending from an edge of a horizontal shelf, said fixture holder attachment means comprising a U-shaped member possessing first and second legs and outwardly facing protruding flat sections for engagement to said C-shaped channel molding, a first leg of said U-shaped member having a cylindrical channel for releasably capturing an edge of a baffle plate, the baffle plate having a cylindrical edge sized to rotatably fit within said cylindrical channel whereby when the baffle plate is rotated so that when it is not in contact with the second leg of said U-shaped member, said U-shaped member can be compressed to facilitate its application to and removal from said C-shaped channel, but once said baffle plate is rotated within said cylindrical channel so that it becomes in contact with said second leg of said U-shaped member, said U-shaped member cannot be sufficiently compressed to a degree where said outwardly protruding flat sections can be disengaged from said C-shaped channel.

2. A method of attaching a fixture holder to a C-shaped channel molding extending from an edge of a horizontal shelf comprising providing a fixture holder attachment means which comprises a U-shaped member possessing outwardly facing protruding flat sections, emanating from first and second legs of said U-shaped member, said U-shaped member being characterized as possessing a cylindrical channel for rotatably receiving a baffle plate, providing the baffle plate having a cylindrical edge sized to fit within said cylindrical channel applying said baffle plate to said U-shaped member by inserting said cylindrical edge into said cylindrical channel, applying inwardly directed pressure to the first and second legs of said U-shaped members so that said outwardly facing protruding flat sections pass between and are captured by inwardly extending lips of said C-shaped channel molding, rotating said baffle plate so that an edge thereof snugly engages the second leg of said U-shaped member such that said baffle plate applies outwardly directed pressure to the legs of said U-shaped member to substantially prevent disengagement of said outwardly facing protruding flat sections from said C-shaped channel.

* * * * *